United States Patent [19]

Middeldorf

[11] 4,273,348

[45] Jun. 16, 1981

[54] ROLL STABILIZING APPARATUS FOR VEHICLES

[75] Inventor: Martin Middeldorf, Waltrop, Fed. Rep. of Germany

[73] Assignee: DeMag Aktiengesellschaft, Duisburg, Fed. Rep. of Germany

[21] Appl. No.: 15,604

[22] Filed: Feb. 23, 1979

[30] Foreign Application Priority Data

Feb. 23, 1978 [DE] Fed. Rep. of Germany ..... 2807765

[51] Int. Cl.[3] ..... B62D 63/04

[52] U.S. Cl. ..... 280/112 A; 105/168; 105/176; 105/199 A

[58] Field of Search ..... 280/47, 81 R, 86, 772, 280/111, 126, 112 A; 105/164, 165, 167, 168, 176, 199 R, 199 A, 210

[56] References Cited

U.S. PATENT DOCUMENTS

| | | | |
|---|---|---|---|
| 3,810,429 | 5/1974 | Kallenbach | 105/210 |
| 3,911,830 | 10/1975 | Adams | 105/164 |
| 4,175,494 | 11/1979 | Moser | 105/168 |

*Primary Examiner*—John J. Love
*Assistant Examiner*—Ross Weaver
*Attorney, Agent, or Firm*—Mandeville and Schweitzer

[57] ABSTRACT

An arrangement is provided in vehicles and particularly rail vehicles which utilizes the spacing variation between two trucks or undercarriages of the vehicle progressing through a curve to cause a tilting movement of the vehicle chassis in the curve to accommodate the centrifugal forces generated by the vehicle in the curve. This is achieved by transposing the generally horizontal forces of the above mentioned spacing variation into opposing vertical forces on each side of the chassis through various mechanical linkages. This avoids provision for elevations of the roadway in curves.

6 Claims, 7 Drawing Figures

ROLL STABILIZING APPARATUS FOR VEHICLES

BACKGROUND AND STATEMENT OF THE INVENTION

The invention involves a vehicle with an apparatus to incline the chassis in curves versus its undercarriages, which rotate versus the chassis around vertical axes. We know that rail tracks are elevated in curves in order to balance, at least partially, the centrifugal forces arising in the vehicle. The installation of such elevations, however, is rather involved. Therefore, vehicles have been developed which, when passing through curves, incline the chassis toward the inside of the curve. U.S. Pat. No. 3,717,104 discloses an apparatus wherein a centrifugal meter places the chasis at a slant versus the undercarriage via a hydraulic control device. This expenditure may be justified for big railroad cars, but not for small vehicles.

It is the object of the present invention to provide a simple device to tilt the chassis versus its undercarriage during curves. This is done by providing, between neighboring undercarriage parts where the longitudinal distance changes while passing through a curve, a device which transforms the change in distance into a movement tilting the chassis towards the inside of the curve. When passing a curve, the distance between the undercarriage decreases on the inside of the curve and increases on the outside of the curve. This change in distance is, without great expenditure, used to tilt the chassis versus the undercarriages, one of which is a swivel base. Thus, it is possible to have a device to incline the chassis versus its undercarriages using simple means. The tracks do not require expensive elevations in curves and can simply be arranged horizontally. The undercarriages are interconnected by means of a distancing bar in the longitudinal center axis of the vehicle.

According to another detail of the invention, the device consists of toggle levers hinged between front and rear undercarriages on each side of the vehicle while the connecting points of each toggle levers are joined with the chassis. When passing through a curve, the distances change between the terminal points of the toggle levers. The connecting point of the toggle lever on the inside of the curve is pressed down, if arranged accordingly, thus transmitting this movement to the chassis, which is raised on the outside of the curve by the toggle lever arranged there, as the terminal points of the toggle lever have experienced a change (i.e. increase) in distance.

Since the chassis is very often supported on the undercarriages via springs, this has to be taken into consideration in the tilting apparatus. Therefore, a cross stabilizer is arranged between the connecting points of the toggle levers and the chassis. This consists of a bar with angled extensions on both ends, whose central cross bar portion pivots in bushings at the sides of the chassis and whose pendulum leg ends are flexibly joined to the connecting points of the toggle levers. When there are spring movements by the chassis versus the undercarriage the cross stabilizer turns in its bearings. It is in itself non-rotatable and is lifted on one side and lowered on the other side during curves and transmits this movement to the chassis. Between the terminal points of the pendulum legs of the cross stabilizer and the connecting points of the toggle levers, intermediate bars may be provided which permit relative movements in longitudinal and lateral direction of the vehicle between the connecting points of the toggle levers and the terminal points and the pendulum legs.

If the springs are arranged between axles and undercarriages and the chassis rests on the undercarriages without springs, the apparatus may consist of a pole firmly attached to one undercarriage and equipped with ropes which lead to fixed points in the chassis around pulleys arranged vertically on the sides of the other undercarriage. In order to achieve the desired incline, the pole may project into the neighboring undercarriage. Likewise, the apparatus may consist of two tension ropes or the like, which are respectively attached to the diagonally opposite ends of the neighboring undercarriages, lead roughly in a straight line to the neighboring undercarriage and from there around a first horizontal pulley and a second vertical pulley arranged on the other side of the undercarriage, from where the ropes go to a fixed point in the chassis.

The apparatus may also consist of a pressure medium system with at least two working cylinder chambers arranged between the neighboring undercarriages and at least one piston movable by one of the undercarriages during the passage of curves. The working cylinder chamber increasing during curves is connected to a lift cylinder arranged on the inside of the curve between undercarriage and chassis, facilitating the lowering of the chassis, and the working cylinder chamber decreasing in curves is connected to a lift cylinder arranged on the outside of the curve between undercarriage and the chassis, effecting an elevation of the chassis, each via a pressure medium line. The desired lift may be achieved by means of synchronizing the cylinder diameters.

The working cylinder chambers may be arranged in one common cylinder shell, separated from each other by the piston, whereby the cylinder shell is attached to one undercarriage and the piston to the other undercarriage. It is also possible to arrange two working cylinder chambers in two different cylinder shells on both sides of the longitudinal axis of the vehicle, each provided with a piston. The lift cylinders and their pistons are arranged between one of the undercarriages and the chassis with vertical direction of movement.

Several examples of the invention are shown on the drawings and explained as follows:

DETAILED DESCRIPTION OF THE INVENTION

Figure 1:
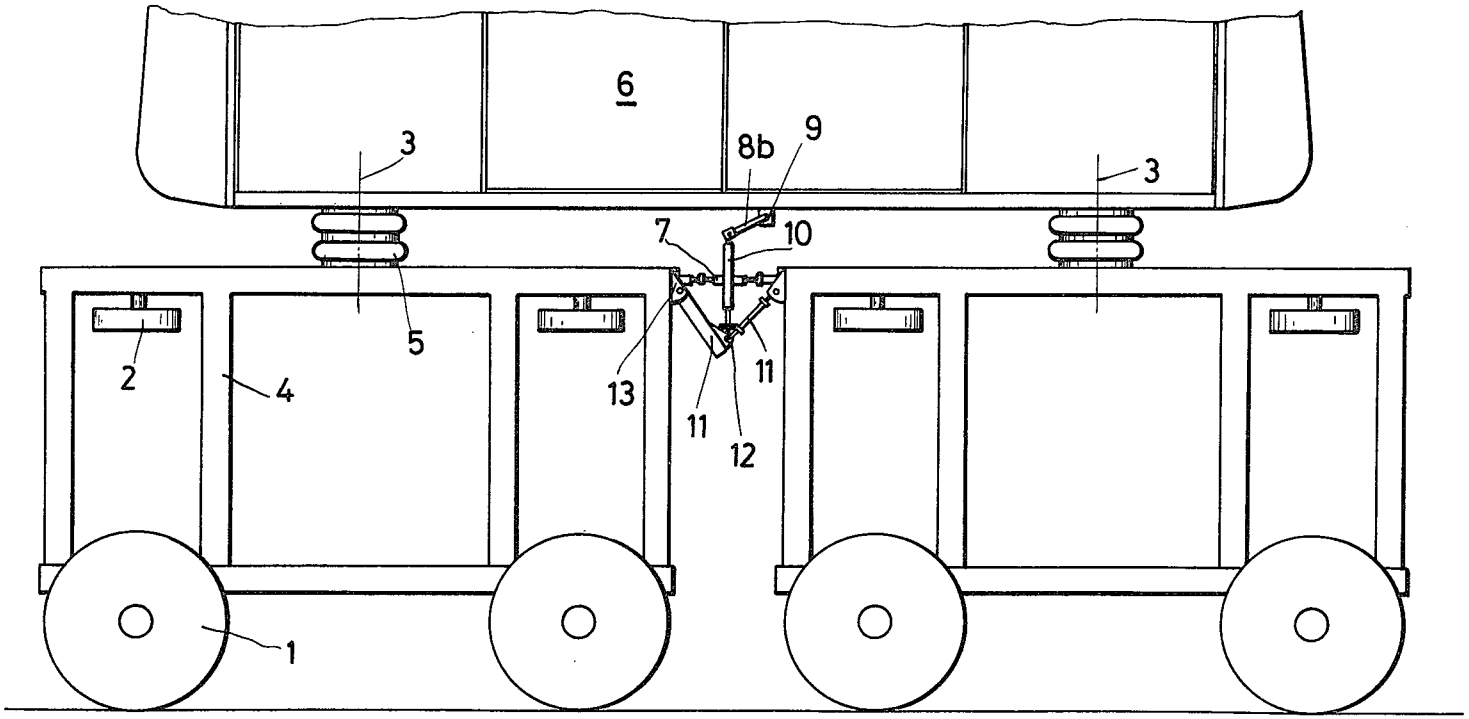
FIG. 1 is a somewhat diagrammatic side elevational view of apparatus illustrating the invention.
Figure 2:
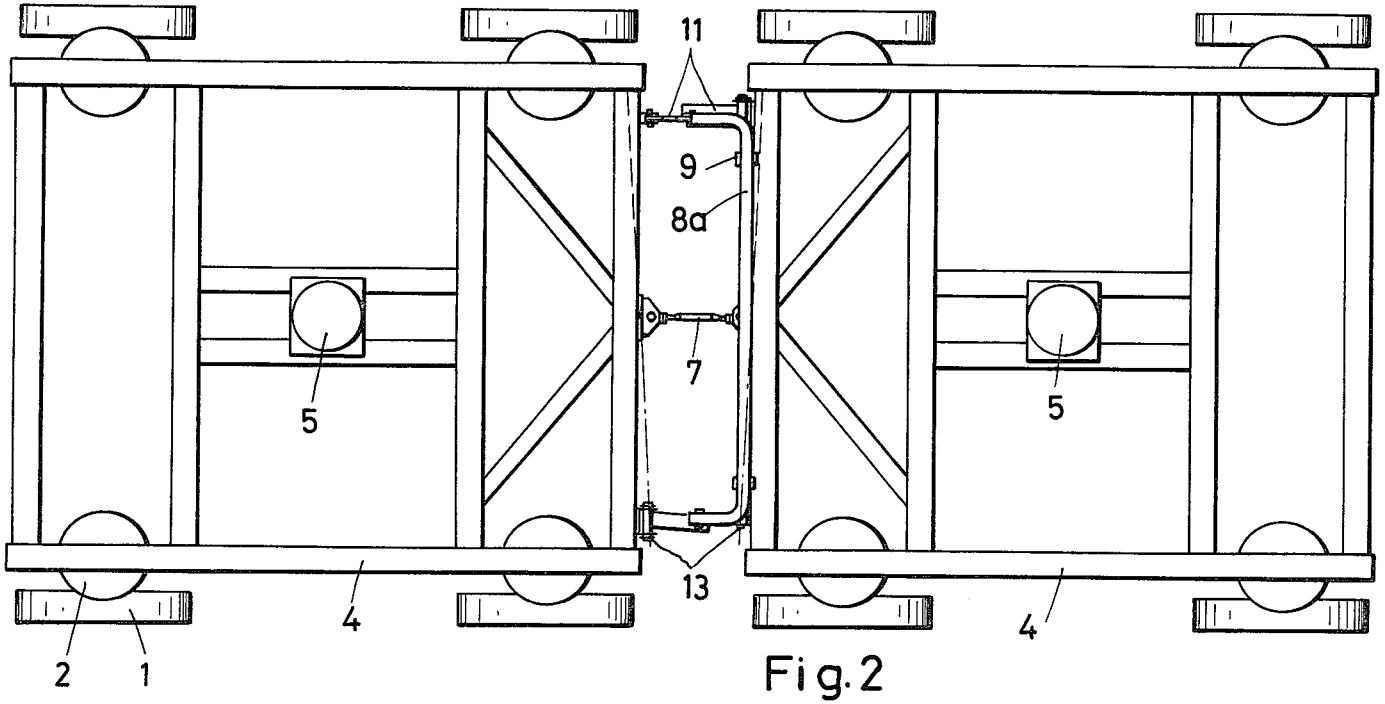
FIG. 2 is a top plan view of the undercarriages of FIG. 1.

According to FIGS. 1 and 2, two undercarriages 4 are on each provided with support wheels 1 and lateral or side guide rolls 2, together carrying chassis 6 via springs 5. The springs 5 consist of air springs arranged in the longitudinal axis of the vehicle; during curves the undercarriages 4 swivel around their vertical axes 3 versus chassis 6. The undercarriages 4 are interconnected by means of a spacer bar 7 arranged in the longitudinal axis. Furthermore, the undercarriages 4 are connected to one another on both sides via toggle levers 11 pointing down in connecting points 12 and resting in lever bearings 13. From these connecting points 12, intermediate bars 10 lead vertically to the top to a cross stabilizer 8, resting with its central cross bar portion 8*a*, according to FIG. 2, at the sides of chassis 6 by means of bushings 9. The cross stabilizer 8 is provided with pendulum legs 8*b* slanting down to engage the intermediate bars 10 at the vehicle sides. The incline of the pendulum legs 8*b* changes with the elevation of springs 5.

FIG. 2 shows, besides a plan view, the cross beams of the undercarriages 4 during curves, connected via the distancing bar 7 and the toggle levers 11, the outside of the curve being shown in broken lines and the inside of the curve being indicated by dot-dash lines. The change in distance of undercarriages 4 is shown on drawings 3 and 4 in broken and dot-dash lines as well.

Figure 3:
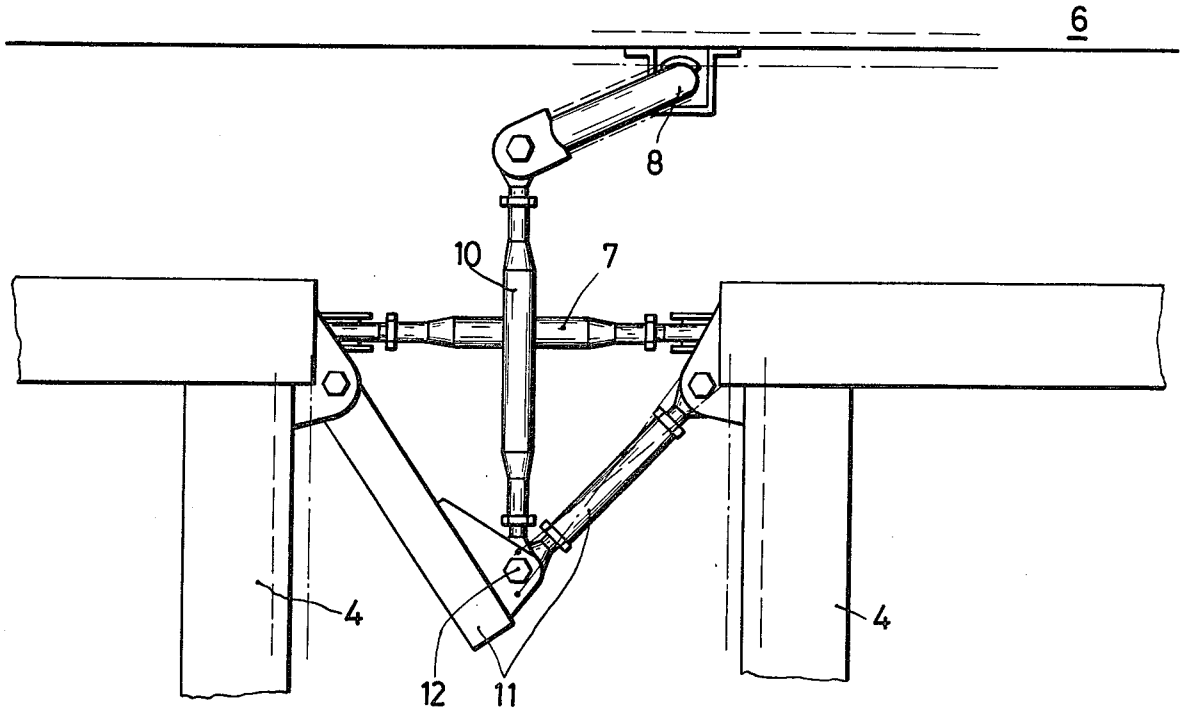
FIG. 3 is an enlarged detailed showing of the undercarriage connection shown in FIG. 1.

According to FIG. 3, the outer toggle lever 11, according to the right bar in broken line, is stretched and rises, while the inner toggle lever in dot-dash line, is compressed. The connecting point 12 migrates upwardly on the outside of the curve and downwardly on the inside. This movement is transmitted via intermediate bar 10 to cross stabilizer 8, drawn in broken line for the outside of the curve and in dot-dash line for the inside of the curve. The incline of the warp-resistant cross stabilizer 8 is transmitted to chassis 6, tilting the latter according to the radius of the curve formed by undercarriages 4.

Figure 4:
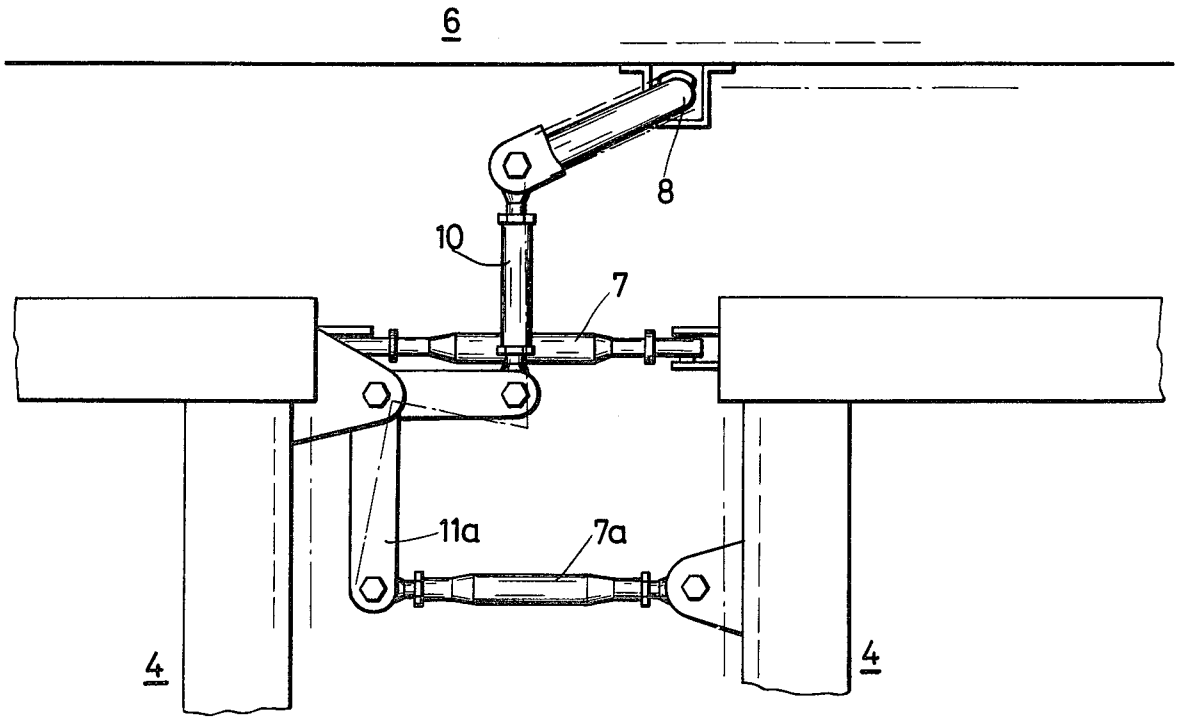
FIG. 4 is a further enlarged detailed showing similar to FIG. 3, but showing a further embodiment of the invention.

In the embodiment of FIG. 4, chassis 6 is connected, via cross stabilizer 8 and intermediate bars 10, with toggle levers 11*a* designed as constant angles, their pivots being arranged at one of the undercarriages, while they are tilted during curves via distancing bars 7*a* from the other undercarriage. Toggle lever 11 arranged on the inside of the curve is indicated in the changed position by dot-dash lines.

Figure 5:
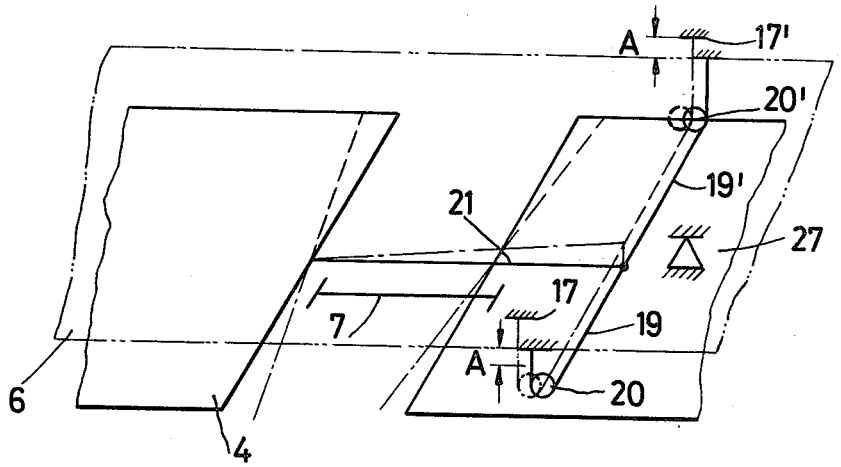
FIGS. 5, 6 and 7 are schematic perspective showings of further embodiments of the invention.
Figure 6:
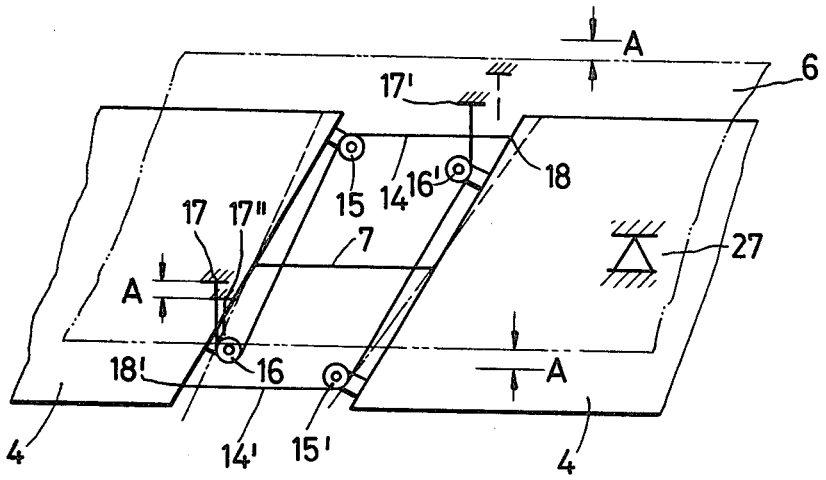
Figure 7:
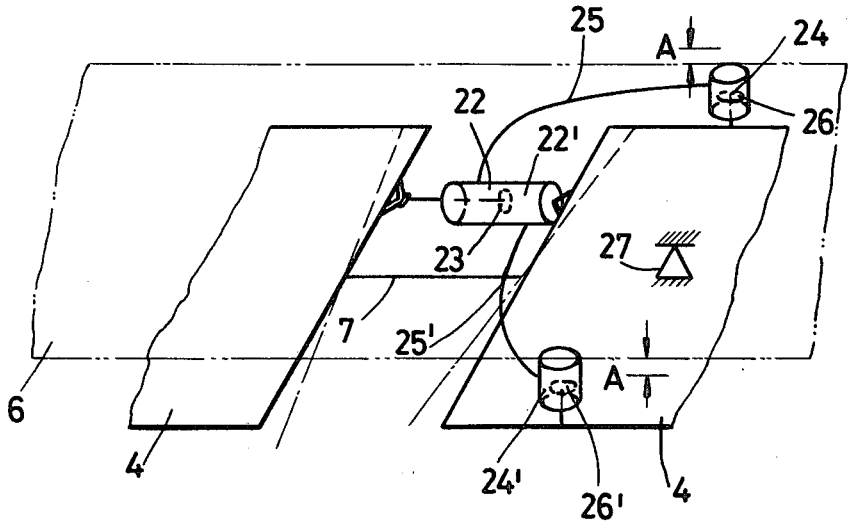

FIGS. 5 through 7 shows schematically in perspective undercarriages 4 and chassis 6 joined by spacer bar 7. The change of distance is shown in dot-dash lines on the inside of the curve, and in broken lines on the outside of the curve. The incline of the chassis, not resting on the undercarriage by means of springs, around support 27 provided in the center of the vehicle, is indicated by A. According to the example in FIG. 5, the left undercarriage 4 comes attached with a pole 21 projecting into the right undercarriage and provided at the end with two ropes 19 and 19'. These lead around pulleys 20, and 20' respectively, to fixed points 17 and 17' on the chassis, tilting it during curves around support 27.

In the example shown in FIG. 6, tension ropes 14 and 14' lead from diagonally opposite fixed points 18 and 18' around pulleys 15 and 15' rotating around vertical axes as well as around pulleys 16 and 16' rotating around horizontal axes to fixed points 17 and 17' on the chassis. While passing through a curve, tension rope 14 starting at fixed point 18 on the outside of the curve pulls chassis 6 at fixed point 17 down to point 17'' by the extent of A, while tension rope 14' gives, making it possible to tilt the chassis around support 27, thus permitting a rise on the outside of the curve.

In the example shown in FIG. 7 a cylinder piston unit is arranged between the two carriages. The cylinder shell with the working cylinder chambers 22 and 22' is hinged at the right undercarriage 4 and the piston 23 with its piston rod is hinged at the left undercarriage. Cylinder chambers 22 and 22' are connected via pressure medium lines 25 and 25' with lift cylinders 24 and 24' arranged between undercarriage and chassis with their pistons 26 and 26', their incline during curves caused by the movement of piston 23 in the cylinder shell with working cylinder chambers 22 and 22'. In the curve shown, working cylinder chamber 22 decreases in size, and the pressure medium chamber in lift cylinder 24 must accordingly increases in size, tilting and chassis around support 27. The enlargement of working cylinder chamber 22' allows the piston 26' into lift cylinder 24', thus lowering the chassis on the inside by the curve by A.

I claim:

1. Apparatus for vehicles to accommodate centrifugal forces when the vehicle is traversing a curve, comprising (a) a vehicle chassis;

(b) a pair of spaced undercarriages for said chassis;

(c) each undercarriage pivotal on a vertical axis on said chassis; the improvement characterized by (d) first mechanical linkage means disposed between said spaced undercarriages and moving in response to relative horizontal displacement between said undercarriages when traversing curves; and (e) second mechanical linkage means disposed between said first mechanical linkage means and said chassis for transposing said movement of said first mechanical linkage means into relative vertical displacement between said undercarriages and said chassis.

2. The apparatus of claim 1, further characterized by (a) said first mechanical linkage means includes a spacer bar disposed in the longitudinal axes of said spaced undercarriages.

3. The apparatus of claim 2, further characterized by (a) said first mechanical linkage means includes a toggle lever connecting said undercarriages along each side edge thereof; and (b) said second mechanical linkage means connecting the mid-pivot point of each toggle lever to said chassis.

4. The apparatus of claim 3, further characterized by (a) springs disclosed in the pivot axis of each undercarriage between each said undercarriage and said chassis;

(b) said second mechanical linkage means includes (1) a U-shaped transverse stabilizer bar rotatable in bearings on said chassis;

(2) angled integral legs on each end of said stabilizer bar; and (3) a spacer bar connecting each integral leg and the respective mid-pivot point of each said toggle lever.

5. The apparatus of claim 1, further characterized by (a) said first and second mechanical linkage means includes (1) a pole connected to one undercarriage and extending into the second undercarriage along the longitudinal axis thereof;

(2) a pulley with a horizontal rotating axis positioned on each side of said second undercarriage;

(3) ropes extending between the end of said pole in said second undercarriage and around each said pulley; and (4) the ends of said ropes opposite said pole attached to said chassis on each side thereof.

6. The apparatus of claim 1, further characterized by said first and second mechanical linkage means including (a) a pair of tension ropes attached to diagonally opposite corners of said spaced undercarriages;

(b) a first pulley with a vertical rotating axis positioned on the corner of each undercarriage opposite the place of attachment of said tension rope;

(c) a second pulley with a horizontal rotating axis positioned on each undercarriage adjacent the point of attachment of said tension ropes; and (d) each said tension rope extending from said point of attachment of an undercarriage around said first pulley with said vertical rotating axis and said second pulley with said horizontal rotating axis to a fixed point on said chassis.

* * * * *